US005191992A

United States Patent [19]

Darley

[11] Patent Number: 5,191,992

[45] Date of Patent: Mar. 9, 1993

[54] TAMPERPROOF SEALING ARRANGEMENT FOR GAS CYLINDERS

[75] Inventor: Derek I. Darley, Chaiwan, Hong Kong

[73] Assignee: Safe T Seal Limited, Nassau, The Bahamas

[21] Appl. No.: 884,019

[22] Filed: May 18, 1992

[30] Foreign Application Priority Data

May 24, 1991 [GB] United Kingdom ..... 9111333

[51] Int. Cl.[5] ..... B65D 51/16

[52] U.S. Cl. ..... 220/214; 220/724; 206/807

[58] Field of Search ..... 220/214, 724, 725, 728; 206/807

[56] References Cited

U.S. PATENT DOCUMENTS 4,103,806 8/1978 White ..... 220/724
4,318,495 3/1982 Wood ..... 220/724
4,736,765 4/1988 Campbell ..... 220/724
4,827,643 5/1989 Hearst et al. ..... 220/724
4,967,923 11/1990 Wren ..... 220/724

*Primary Examiner*—Joseph Man-Fu Moy
*Attorney, Agent, or Firm*—Townsend and Townsend

[57] ABSTRACT

A tamperproof seal arrangement for the pin index outlet valve of a gas cylinder, comprising a body capable of being positioned closely and securely around the pin index valve and having a number of faces matching those of the valve, one face having at least one inwardly directed projection engaging in and matching either the outlet of the valve and/or the pin index hole or holes of the valve, and another face having non-removably associated with it a unique identification marking, that face being joined to adjacent faces by rupturable means, whereby removal of that face with the identification marking will destroy the continuity of the body, whereafter the rest of the body can be removed from the pin index valve to allow use of the pin index valve while it is apparent that the seal arrangement has been destroyed or otherwise visibly damaged.

20 Claims, 5 Drawing Sheets

TAMPERPROOF SEALING ARRANGEMENT FOR GAS CYLINDERS

This invention relates to a tamperproof sealing arrangement for gas cylinders.

In the past, gas cylinders have been provided with sealing mechanisms; however, such have been known to be tampered with by people which has led to potentially dangerous situations.

It is an object of this invention to overcome this problem.

In accordance with the invention a tamperproof seal arrangement for the pin index outlet valve of a gas cylinder, comprises a body capable of being positioned closely and securely around the pin index valve and having a number of faces matching those of the valve, one face having at least one inwardly directed projection engaging in and matching either the outlet of the valve and/or the pin index hole or holes of the valve, and another face having non-removably associated with it a unique identification marking, that face being joined to adjacent faces by rupturable means, whereby removal of that face with the identification marking will destroy the continuity of the body, whereafter the rest of the body can be removed from the pin index valve to allow use of the pin index valve whilst it is apparent that the seal arrangement has been destroyed or otherwise visibly damaged.

Such an arrangement is tamperproof since the contents of the gas cylinder cannot be adulterated without the body of the seal being destroyed or visibly altered in some way. Thus the seal prevents access to, and use of, the valve, and to gain access someone would have to destroy, tear, cut, damage, or in some other way make a visible change to the seal. Also a ne seal cannot replace the original seal used by the company which filled the cylinder since this would be apparent from a change in the identification means which form a permanent part of the seal. Thus if the seal is intact and the identification means match the identification of the cylinder, then this will be apparent to the user and he can have confidence that the gas in the cylinder has not been tampered with or adulterated in some way and, if by contrast, the seal is not intact, that cylinder's gas should not be used.

Suitably the projections comprise pin members integrally formed with the seal which are positioned to protrude firstly into the inlet/outlet valve opening and secondly into the pin index identification hole or holes provided on the inlet/outlet portion of the gas cylinder valve. Since the number of such holes and their relative positioning are different for each type of gas cylinder valve, the corresponding pins on each type of seal are distinctive for each different type of gas cylinder valve. This provides a failsafe mechanism since a unique seal for each type of gas cylinder valve is provided, and it is not possible to us the wrong seal with the wrong type of gas cylinder valve.

Suitably the identification marking comprises a bar code, which bar code is permanently sealed within a cover member or is permanently printed or otherwise impressed on one of the faces of the seal.

The identification marking may correspond to a bar code provided on the gas cylinder itself or to a bar code within a label attached to the gas cylinder. In particular, the bar code can be a random number which is checked only by a computer with the gas cylinder bar code (which is another random number) to form a once only tamperproof code. In other words, after the two bar codes are positioned on a gas cylinder, the two different random numbers can be read by a scanner to input those numbers to the computer, which thereafter checks the two random numbers with each other, and optionally with the serial number stamped on the cylinder itself, and if they do not correspond then it can be assumed that the seal has been replaced and the gas in the cylinder may have been adulterated.

The identification marking is permanently fixed to and/or forms part of the seal so that its removal destroys the seal. The identification marking is removably detachable from the rest of the seal, such that the seal can be removed from the cylinder but the act of removal will destroy or otherwise visibly damage the seal. Once the identification marking is removed, the seal is broken and thus not reusable.

Suitably the body also comprises attachment means which permanently secure the body to the inlet/outlet valve of the gas cylinder such that these attachment means can be used once only.

The invention will now be described, by way of example, with reference to the accompanying drawings, in which.

Figure 1:
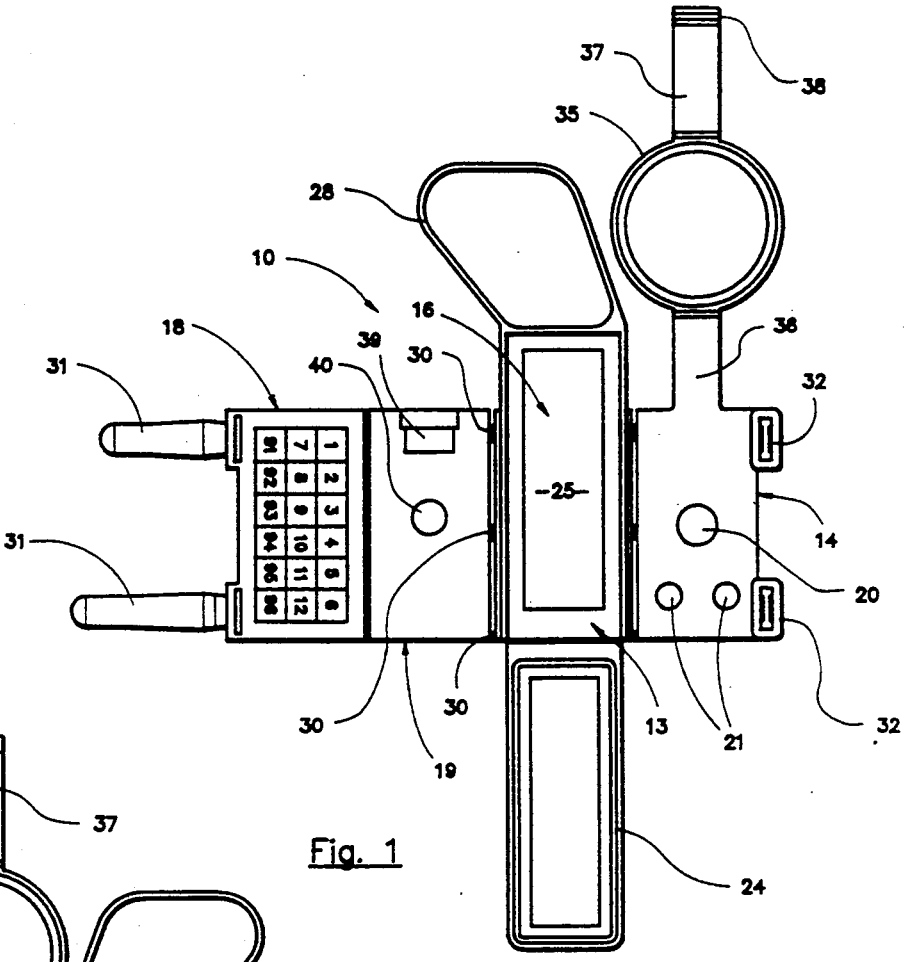
FIG. 1 is a front view of a first embodiment of tamperproof seal for a gas container in accordance with the invention, in an opened out position prior to use.
Figure 2:
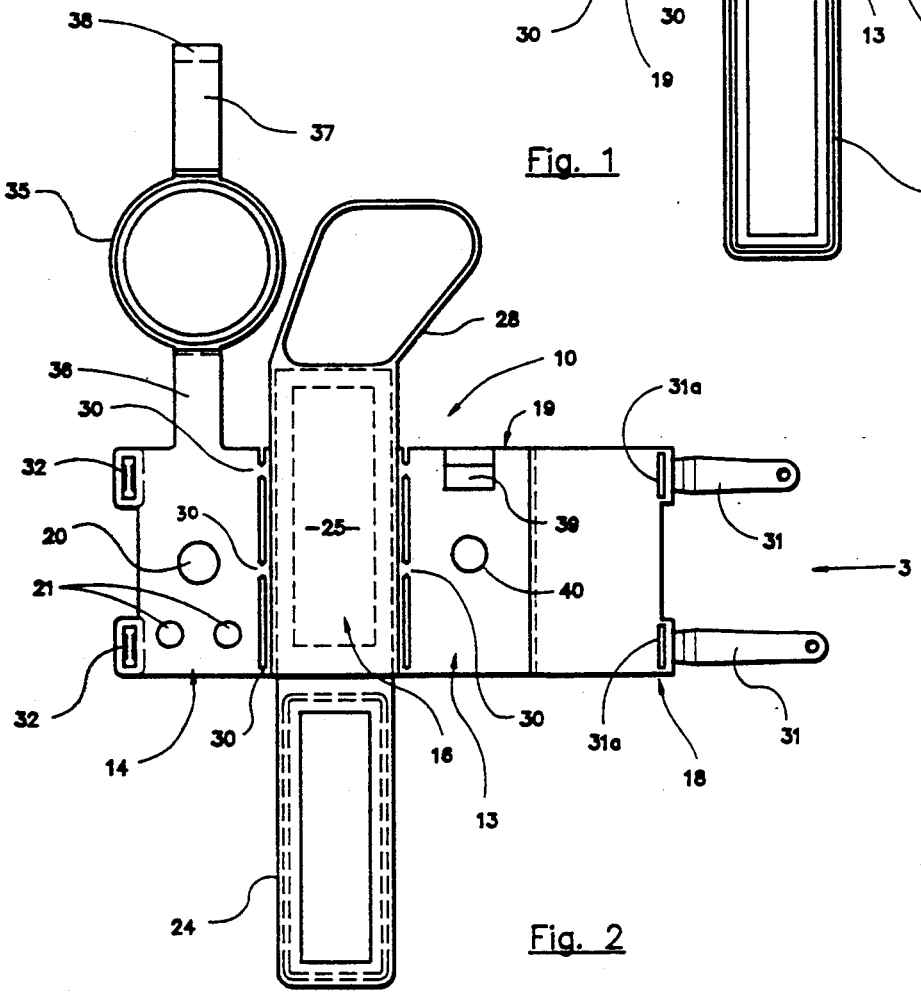
FIG. 2 is a rear view of the seal of FIG. 1.
Figure 3:
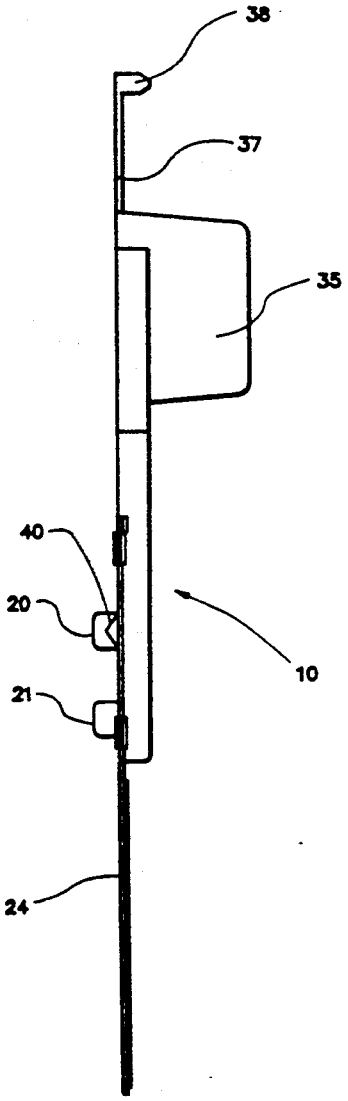
FIG. 3 is a side view of the seal of FIG. 1 looking in the direction of the arrow 3 on FIG. 2.
Figure 6:
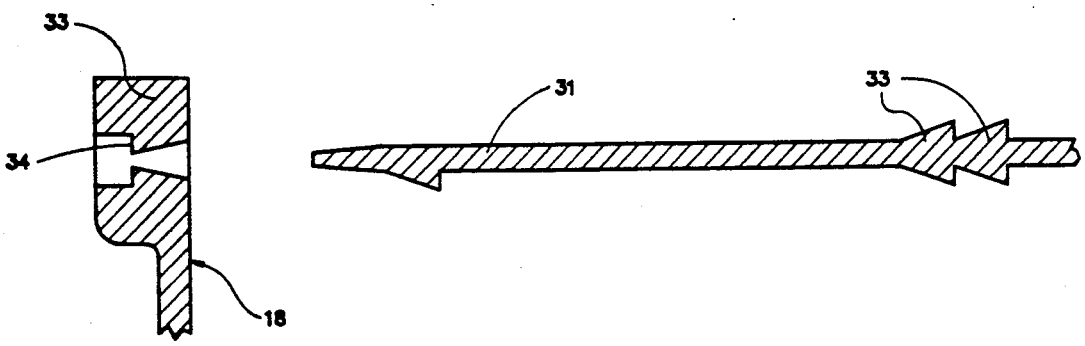
Figure 5B:
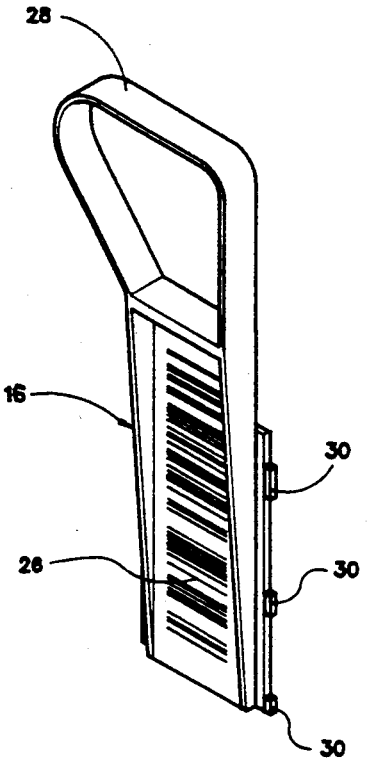
Figure 5C:
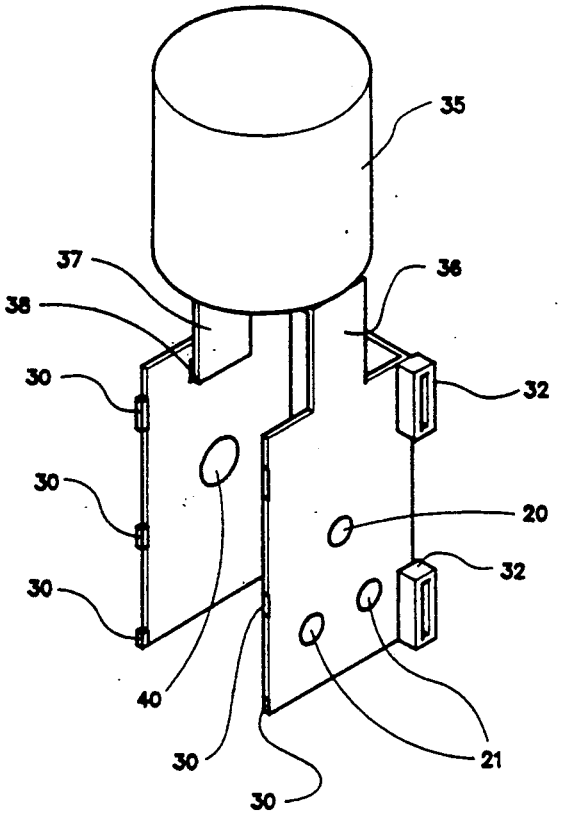
Figure 5A:
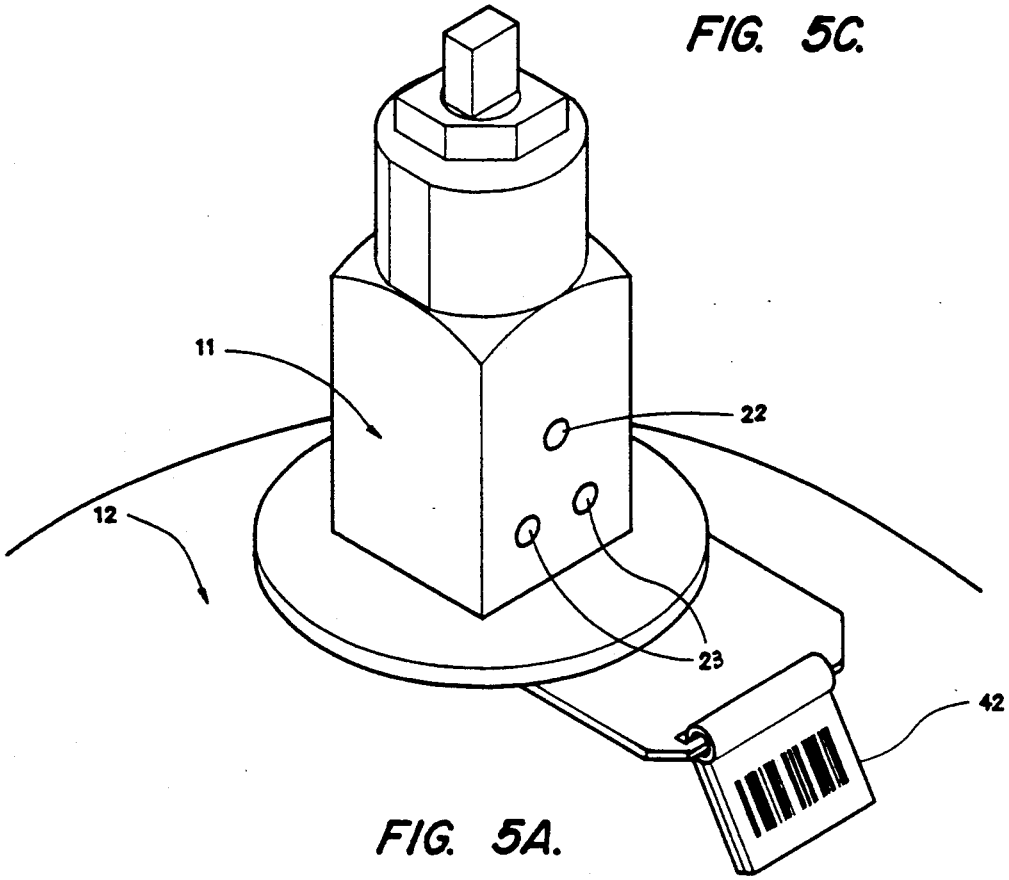
Figure 7:
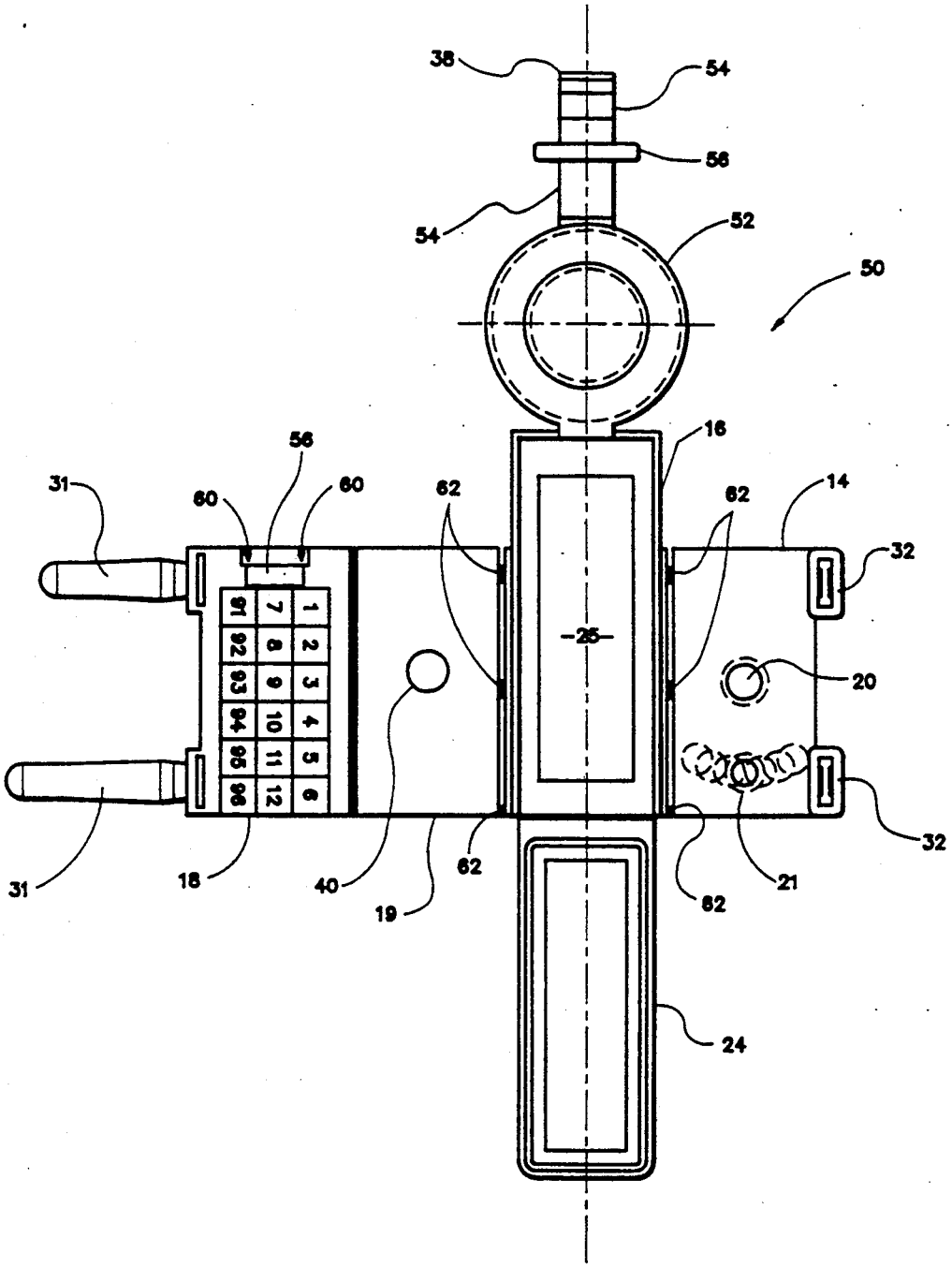
Figure 8:
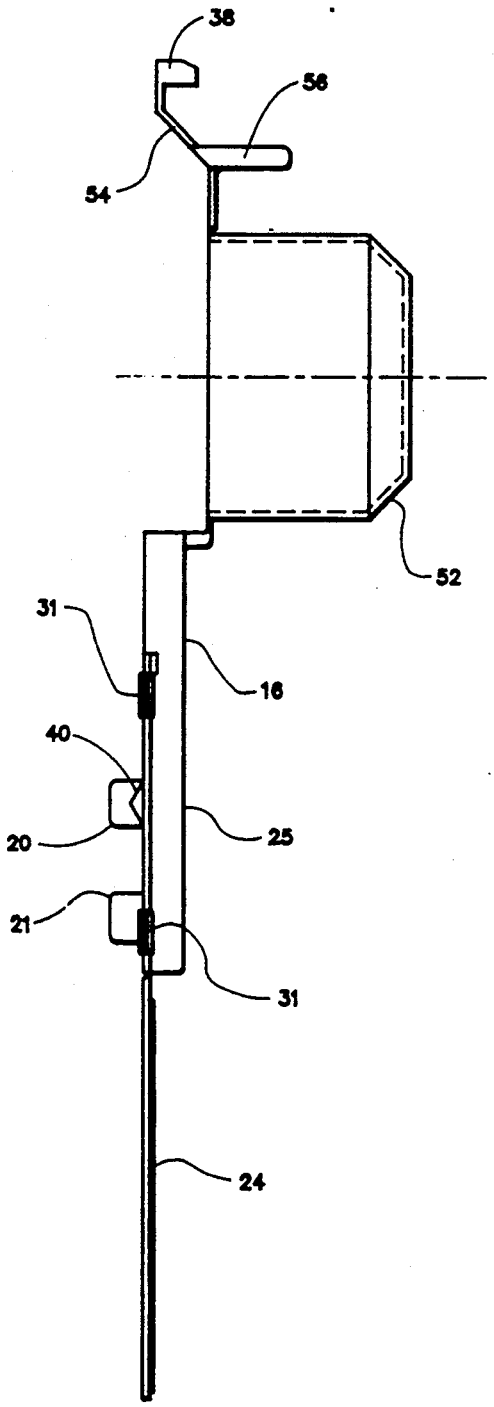

FIGS. 5*a* to 5 *c* show the seal of FIG. 1 being removed from the top of the gas cylinder;

FIG. 6 is an enlarged cross sectional detail of the seal of FIG. 1;

FIG. 7 is a front view of a second embodiment of a tamperproof seal for a gas container in accordance with the invention, in an opened out position prior to use;

FIG. 8 is a side view of the seal of FIG. 7; and

Figure 9:
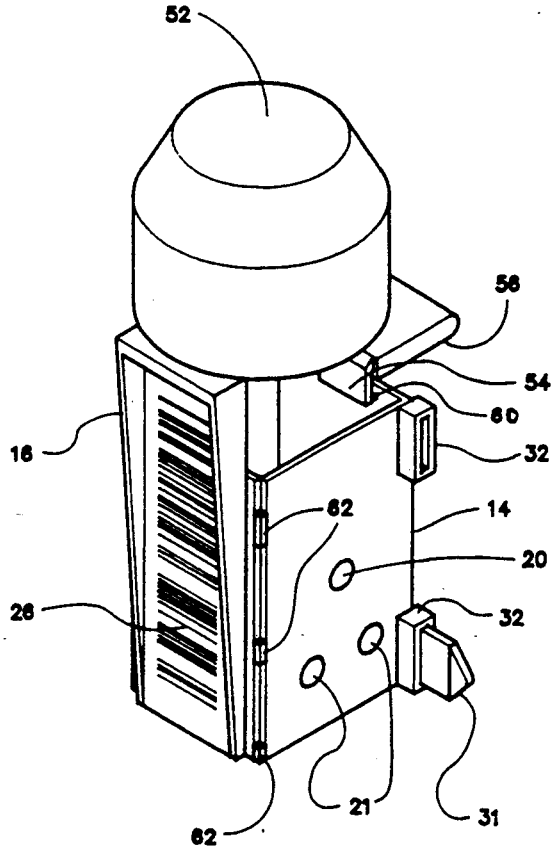

FIG. 9 shows the seal of FIG. 7 as it would be seen in use on the top of a gas cylinder.

In FIGS. 1 to 6 of the drawings, a tamperproof seal 10 for a pin index valve 11 for a gas cylinder 12 is shown. It comprises a body portion 13 of synthetic plastics material which has four face portions, namely a matching pin index face portion 14, an identification marking face portion 16, an attachment means face portion 18, and a cap connecting face portion 19.

The matching pin index portion 14 has inwardly projecting pins 20 and 21. The pin 20 matches the position of the inlet/outlet valve opening 22 of the valve 11 whilst the pins 21 match the position and number of the pin index holes 23 (see FIG. 5) provided in the inlet/outlet part of the valve 11. Since the number and position of these holes 22 is different for each type of gas, a tamperproof seal provided with the same number and positioning of pins will be unique to that type of gas cylinder valve with which it is to be connected, attached and used. In FIGS. 1 to 6 of the drawings, a seal 10 suitable for the valve of an oxygen gas cylinder 12 is shown. Other seals have differing positions for the holes 23 and sometimes only one hole 23.

The identification marking face portion 16 of the seal 10 comprises a cover member 24 and a base member 25 between which an identification marking in the form of a bar code 26 (see FIG. 4), a unique number or the like can be permanently positioned and secured. In particular, the cover member 24 may be ultrasonically welded to the base member 25 to position and secure the bar code 26 or other printing permanently therebetween. This arrangement is not essential, however, and alternatively the bar code or number may be printed or impressed directly on the base member 25 and the cover member 24 omitted. The base member 25 is also provided with a loop 28 whereby the finger of a user can be positioned in this loop to remove the identification portion 16 which is detachably secured on both its sides to the rest of the seal by rupturable means in the form of small isolated thin hinges 30 or perforated lines.

The attachment means face portion 18 meanwhile is provided with two sidewardly extending lugs 31 which engage with two locking members 32 provided on the face portion 14. As best seen in FIG. 6, these lugs 31 have tooth-shaped projections 33 which can lock with a shoulder 34 formed in the locking members 32. The lugs can be inserted into, but not removed from, the members 32. Close to the junction of the lugs 31 with the body of the portion 18, the latter is weakened by slots 31*a*. Therefore any attempt to pull the lugs 31 from the members 32 will tear the lugs from the portion 18. Once the lugs 31 have been fully inserted into the locking members 32 against the shoulders 34, the outer free ends of the lugs 31 are cut off to prevent any person from releasing the seal and being able to resecure the seal together. Thus the lugs 31 are made of such a strength that they can be pulled through, but not pushed through, the members 32.

Also integrally formed with the portion 14 is a cap 35 for the valve 11. This cap 35 is optional. It is joined to the portion 14 by a connecting link 36. Also it has a closure member 37 extending away from the link 36, the closure member having an enlarged end 38.

The cap connecting face portion 19 is provided with an opening 39 through which the end 38 of the cap 36 is positioned. This traps the cap in place when the seal 10 is in position. Further an inwardly directed conical projection 40 is formed to engage with a corresponding indent not shown) in the valve 11.

Figure 4:
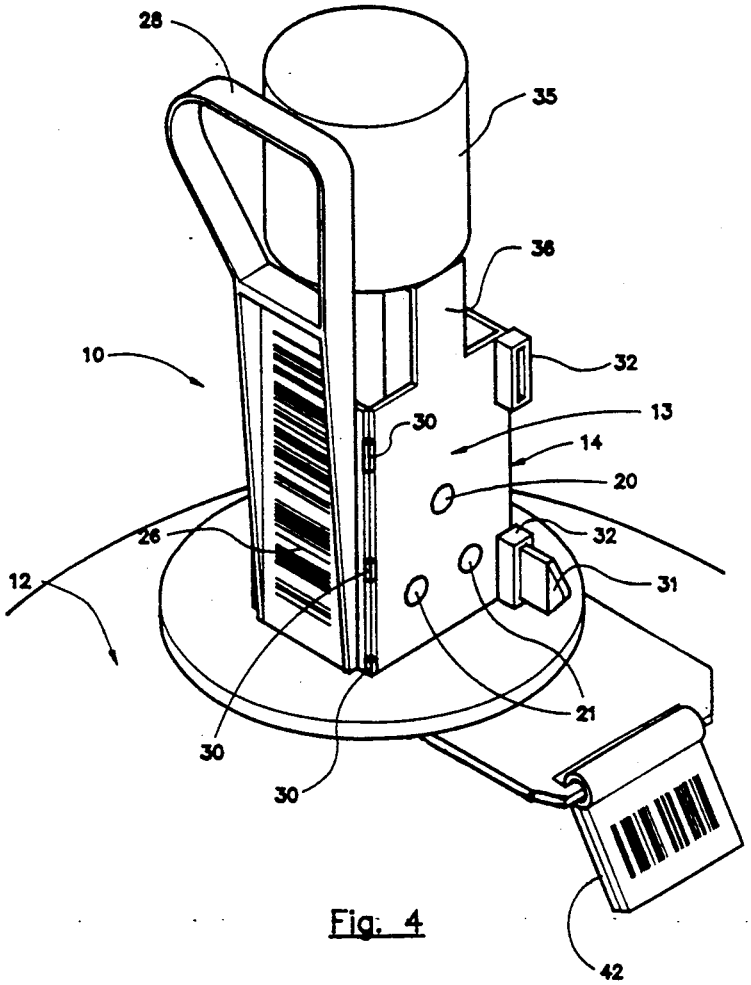
FIG. 4 shows the seal of FIG. 1 in use attached to the top of a gas cylinder.

In FIG. 4, the seal 10 is shown attached to the valve 11 (see FIG. 5) of a filled gas cylinder 12. To attach the seal, the pins 20 and 21 of the seal 10 are positioned in the holes 22 and 23 of the valve. Then the tamperproof seal 10 is folded about and around the valve 11, and the cap 36 is folded over the top of the valve and secured to the side portion 19 as the seal is being folded around the valve by placing the end 38 in the opening 39. Thereafter, the lugs 31 are placed through the locking members 32, and the outer ends of the lugs cut off. The seal 10 is thus secured in place and cannot be removed without destroying the seal in a way which is apparent and readily visible.

In FIG. 4, the bar code 26 within the identification face portion 14 and the bar code provided on a label 42 attached to the gas cylinder together to provide a unique combination. In particular, the bar code 26 on the identification means is a random number which is checked only by a computer with the gas cylinder bar code on the label 42 (which is another random number) to form a once only tamperproof code. Furthermore, the gas cylinder bar code can be checked by the computer with the serial number stamped on the cylinder 12. In particular, the two different random numbers on the bar codes can be read by a scanner to input those numbers to the computer, which thereafter checks the two random numbers with each other and optionally with the serial number stamped on the cylinder itself to ensure that all correspond to the initial combination when the cylinder was filled and sealed.

The seal 10 is removed from the valve 11 just prior to use of the cylinder (see FIG. 5) by tearing the identification face portion 16 from the rest of the tamperproof seal. Then the rest of the seal can be removed from the valve 11 of the gas cylinder 12. The identification face portion 16 is removable from the rest of the seal since it is joined by the small hinges 30 to the rest of the seal, and the detached identification side portion 16 can thereafter be retained for record purposes.

As best shown in FIG. 1 the outside wall of the portion 18 can have a grid moulded into it with date information in the boxes of the grid so that the company which fills the cylinder can punch out appropriate boxes to signify the date of filling. Then the user can easily follow a first-in first-used procedure.

In FIGS. 7 to 9 of the drawings, a further embodiment of a tamperproof seal 50 is shown, similar to the tamperproof seal 10 shown in FIGS. 1 to 6.

The only differerences between the seal shown in FIGS. 7 to 9 and the seal shown in FIGS. 1 to 6, is that the cap 52 of seal 50 provides the function of both the cap 35 and the loop 28 of the seal 10.

In particular, the cap 52 has the dual function of firstly covering the top of the cylinder head, and secondly acting as a grip so that the identification face portion 16 of the seal 50 can be ripped off.

Suitably the cap 52 has an extension 54 which connects with a cap securing opening 56 provided in the attachment means face portion 18 (and not in the cap connecting face portion 19 as in the seal 10), and a ledge portion 58 which extends outwardly from the extension 54 such that when the cap 52 is secured in the opening 56 (see FIG. 9), a person can grab the ledge portion 58, and disconnect the cap 52 from the attachment means face portion 18 (which is perforated with holes 60 adjacent the opening 56 in order to allow easier detachment). Thereafter, the person holding the ledge portion 58 can pivot the cap 52 so that it no longer covers the top of the cylinder head, and then outward pulling of the cap 52 will then remove the identification face portion 16 from the rest of the seal 50, since rupture means in the form of perforations 62 are provided on each side of the identification face portion 16 (ie with the matching pin index face portion 14 and the face portion 19).

In all other ways, however, the seal 50 of FIGS. 7 to 9 is identical to the seal 10 shown in FIGS. 1 to 6.

Such seals as shown in the drawings provide tamperproof and easy methods of identification of a gas within a gas cylinder.

In particular, a certain type of gas seal can only be used with a particular type of gas cylinder valve corresponding to the matching pins 21 and holes 23. Furthermore, the seal itself can be solidly colour coded to correspond with the existing standard colour code of the gas within the gas cylinder.

Also the identification face portion 16 is provided with a bar code 26 which provides a unique identification for the gas cylinder, and can provide details as to the specific gas cylinder and the gas contained therein. The arrangement is such that the bar code in this identification face portion must match with the bar code in the label 42 provided on the gas cylinder and optionally the serial number stamped on the gas cylinder itself, and then and only then does one have absolute confirmation that the gas cylinder has not been tampered with, because the codes identify the cylinder and the seal, assuming it is still intact, and the seal ensures that it has not been possible to gain access to the gas in the cylinder.

In conclusion, the tamperproof valve seals shown in the drawings provide arrangements such that the contents of a gas cylinder, once within the gas cylinder and the seal having been attached, cannot be tampered with or adulterated by a person without destroying the seal or it being visibly apparent that there has been tampering with the seal, and the seal fitted by the filling company cannot have been replaced by a different seal if the code 26 is to match with the identification on the cylinder.

I claim:

1. A tamperproof seal arrangement for the pin index outlet valve of a gas cylinder, comprising a body capable of being positioned closely and securely around the pin index valve and having a number of faces matching those of the valve, one face having at least one inwardly directed projection engaging in and matching either the outlet of the valve and/or the pin index hole or holes of the valve, and another face having non-removably associated with it a unique identification marking, that face being joined to adjacent faces by rupturable means, whereby removal of that face with the identification marking will destroy the continuity of the body, whereafter the rest of the body can be removed from the pin index valve to allow use of the pin index valve whilst it is apparent that the seal arrangement has been destroyed or otherwise visibly damaged.

2. A seal as claimed in claim 1 wherein the identification marking comprises a bar code.

3. A seal as claimed in claim 2 wherein the bar code is permanently sealed within a cover member.

4. A seal as claimed in claim 2 wherein the bar code is permanently printed on one of the faces of the seal.

5. A seal as claimed in claim 2 wherein the bar code is permanently impressed on one of the faces of the seal.

6. A seal as claimed in claim 1 wherein the identification marking corresponds to an identification marking provided on the gas cylinder itself.

7. A seal as claimed in claim 1 wherein the identification marking corresponds to an identification marking within a label attached to the gas cylinder itself.

8. A seal as claimed in claim 7 wherein the identification marking associated with a face of the seal is a random number.

9. A seal as claimed in claim 8 wherein the identification marking associated with a face of the seal is checkable against the gas cylinder identification marking which is another random number, to form a once only tamperproof code.

10. A seal as claimed in claim 1 wherein the identification marking associated with a face of the seal is fixed to the seal so that its removal destroys the seal.

11. A seal as claimed in claim 1 wherein the identification marking associated with a face of the seal forms part of the seal so that its removal destroys the seal.

12. A seal as claimed in claim 1 wherein the body also comprises attachment means which secure the body to the outlet valve of the gas cylinder, these attachment means being such that they can be used once only.

13. A seal as claimed claim 1 wherein at least one inwardly directed projection is provided on another face of the seal.

14. A seal as claimed in claim 1 wherein the seal is provided with a cap member to cover the top of the valve.

15. A seal as claimed in claim 14 wherein the cap is integrally joined to one face of the seal, and is connectable to another face of the seal.

16. A seal as claimed in claim 1 wherein removal means are provided connected to the face associated with the identification marking, to remove that face from the rest of the seal.

17. A seal as claimed in claim 16 wherein a cap member is provided which also acts as the removal means.

18. A seal as claimed in claim 16 wherein the removal means is integrally connected to the face associated with the identification marking.

19. A seal as claimed in claim 1 which is colour coded in order to indicate which gas is contained within the gas cylinder.

20. A seal as claimed in claim 1 wherein the seal is provided with the same number and orientation of projections to match the number and orientation of pin index holes in the valve with which the seal is to be used.

* * * * *